United States Patent [19]

Weissler, II et al.

[11] Patent Number: 4,957,074

[45] Date of Patent: Sep. 18, 1990

[54] CLOSED LOOP ELECTRIC VALVE CONTROL FOR I. C. ENGINE

[75] Inventors: Harold E. Weissler, II; Robert E. Weber; Russell J. Wakeman, all of Newport News, Va.

[73] Assignee: Siemens Automotive L.P., Troy, Mich.

[21] Appl. No.: 441,790

[22] Filed: Nov. 27, 1989

[51] Int. Cl.[5] ..... F01L 9/04

[52] U.S. Cl. ..... 123/90.11; 73/118.1; 251/129.05

[58] Field of Search ..... 123/90.11; 251/129.1, 251/129.05; 73/118.1

[56] References Cited

U.S. PATENT DOCUMENTS

| | | | |
|---|---|---|---|
| 3,682,152 | 8/1972 | Muller-Berner | 123/90.11 |
| 3,935,846 | 2/1976 | Zelenka | 123/90.11 |
| 4,544,986 | 10/1985 | Buchl | 123/90.11 |
| 4,706,619 | 11/1987 | Buchl | 123/90.11 |
| 4,782,798 | 11/1988 | Jones | 123/90.11 |
| 4,836,016 | 6/1989 | Nakano et al. | 73/118.1 |

FOREIGN PATENT DOCUMENTS

| | | | |
|---|---|---|---|
| 2616481 | 12/1988 | France | 123/90.11 |
| 0096135 | 6/1983 | Japan | 123/90.11 |
| 0167840 | 10/1983 | Japan | 123/90.11 |
| 0162312 | 9/1984 | Japan | 123/90.11 |

*Primary Examiner*—Charles J. Myhre
*Assistant Examiner*—Weilun Lo
*Attorney, Agent, or Firm*—George L. Boller; Russel C. Wells

[57] ABSTRACT

The actual lift of a valve is monitored by a lift sensor that is coupled to an electronic valve controller by a lift signal processing circuit, and the electronic valve controller issues a control signal that is calculated to secure as faithful correspondence as possible of this lift signal to a command signal that the electronic valve controller receives from an electronic engine management controller. The processing circuit functions to disclose to the electronic valve controller the actual opening and closing instants of the valve in a manner that amounts to the sensor being precisely re-calibrated each time that it closes.

6 Claims, 1 Drawing Sheet

CLOSED LOOP ELECTRIC VALVE CONTROL FOR I. C. ENGINE

BACKGROUND AND SUMMARY OF THE INVENTION

This invention relates to an improvement in an internal combustion engine that has solenoid-controlled cylinder valves.

Historically, the timing and lift of the cylinder valves of an internal combustion engine have been rigidly defined by the design of its camshaft, and that design has typically been a compromise of numerous factors. The advent of solenoid-controlled hydraulic controls for controlling cylinder valve timing and lift enables these parameters to be varied in ways that allow them to be more or less optimized to suit the particular operating needs of the engine as those needs change in accordance with different operating conditions. This capability is especially advantageous when the engine is used as the powerplant of an automotive vehicle.

The present invention arises through the observation of unanticipated, and sometimes sporadic, aberrations in the operation of such solenoid-controlled hydraulic controls and the ensuing recognition that such irregularities are a consequence of uncontrolled factors like hydraulic fluid viscosity, battery voltage, and manufacturing tolerances, to mention a few. Accordingly, the invention provides a solution to this predicament by means of a novel closed loop control system that functions to nullify the undesired effects of certain inherently uncontrolled factors such as those just mentioned. In a general way, the practice of the invention occurs in the following manner. The actual lift of a cylinder valve is monitored by a lift sensor that is coupled to an electronic valve controller by a lift signal processing circuit, and the electronic valve controller issues a control signal that is calculated to secure as faithful correspondence as possible of this lift signal to a command signal that the electronic valve controller receives from an electronic engine management controller. The processing circuit functions to disclose to the electronic valve controller the actual opening and closing instants of the cylinder valve in a manner that amounts to the sensor being calibrated to zero each time that it closes. This allows a relatively inexpensive sensor such as a Hall device to provide sufficient accuracy. In any given engine, the invention may be embodied in the intake valves and/or the exhaust valves.

The foregoing features, advantages, and benefits of the invention will be seen in the ensuing description and claims which should be considered in conjunction with the accompanying drawing which presents a preferred embodiment of the invention according to the best mode contemplated at the present time for carrying out the invention.

DESCRIPTION OF THE PREFERRED EMBODIMENT

Figure 1:
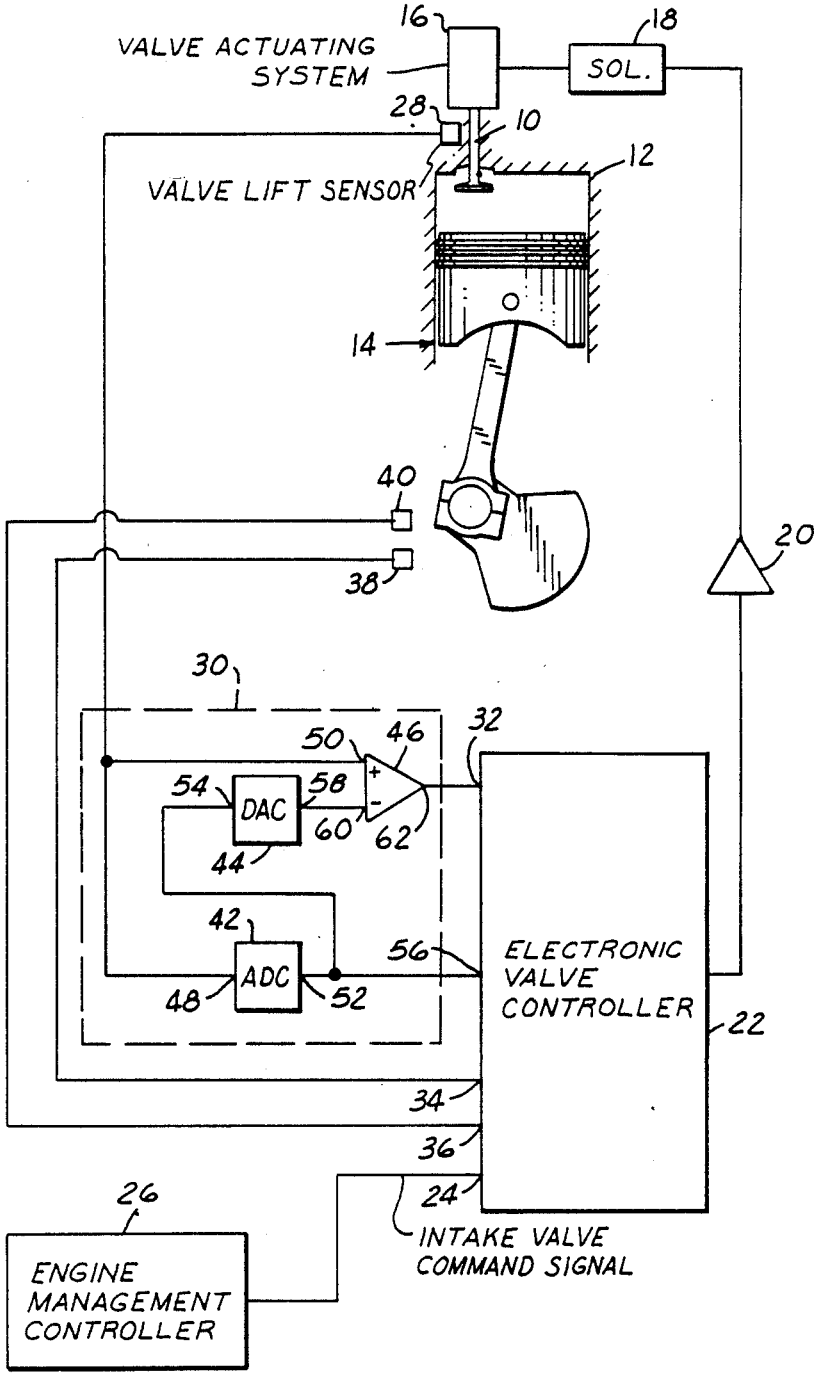
FIG. 1 is a schematic diagram of a closed loop electric valve control for an internal combustion engine according to the present invention.

The drawing illustrates a control embodying the invention in use with an intake valve 10 of a cylinder 12 of an internal combustion engine 14. The engine may be of the multi-cylinder type in which case there would be a number of cylinders each having a corresponding intake valve. Each cylinder would of course also have an exhaust valve even though such a valve is not specifically illustrated in the drawing. While the invention may be practiced with intake and/or exhaust valves, principles may be adequately understood from the ensuing explanation of the single cylinder illustration.

A solenoid-controlled valve system 16 exercises control over the opening and closing of intake valve 10. The system is shown in a generalized form to represent any of a number of known systems because principles of the invention are universally applicable. The system comprises a solenoid 18 that is energized and de-energized in a controlled manner to effect control over the timing and lift of valve 10. Solenoid energization and de-energization are accomplished through a solenoid driver 20 that is operated by an electronic valve controller 22.

Controller 22 is a microprocessor-based device having a number of inputs and outputs. One input 24 receives an intake valve command signal from an engine management controller 26. Controller 26 is a microprocessor-based device that exercises control over a number of engine functions, such as spark and fuel, according to an internal program that acts on a number of parameters that are monitored by various sensors Controller 26 exercises control over the timing and lift of valve 10 by supplying the intake valve command signal to controller 22. Controller 22 then acts upon solenoid 18 in a manner intended to cause valve 10 to obey the command. However, for reasons mentioned earlier, the response of valve 10 to the command may at times be unfaithful on account of uncontrolled factors, such as those mentioned earlier.

The invention provides a solution because controller 22, solenoid driver 20, and system 16 are arranged to be part of a closed loop that ensures as faithful correspondence as possible between the actual response of valve 10 and the command of controller 26. Also forming a part of the closed loop are a valve lift sensor 28 and a lift sensor processing circuit 30.

Lift sensor 28 is disposed in sensing relation to valve 10 to monitor the actual displacement of the valve during opening and closing. The lift sensor forms an input to processing circuit 30, and the output of the processing circuit forms an input to another of the inputs 32 of controller 22. So that controller 22 can perform its intended purpose, it is necessary for it to know true engine crankshaft position, and therefore two additional inputs 34 and 36 of controller 22 are connected to receive signals from two sensors 38 and 40.

Sensor 38 senses rotation of the crankshaft past a particular rotational reference position such as piston top dead center position for a particular cylinder. Sensor 40 provides a pulse timing signal that enables controller 22 to track the position of the crankshaft between passages past the reference position that is periodically sensed by sensor 38. For example, the signal from sensor 40 could represent one degree increments of crankshaft rotation. In this way, one signal synchronizes to a particular position while the second provides finer resolution to account for engine speed variation during an engine cycle. If even finer control is required, the latter signal can be interpolated.

Lift sensor processing circuit 30 comprises an analog to digital converter (ADC) circuit 42, a digital to analog converter (DAC) circuit 44, and a comparator 46, each of which is a conventional electronic device. These devices are connected in a configuration that results in the information from lift sensor 28 being processed to disclose to controller 22 as the valve operates, the actual opening and closing of the valve in a manner that amounts to the lift sensor being accurately re-calibrated each time before the valve opens. The lift sensor is connected to the input 48 of ADC circuit 42 and to the non-inverting input 50 of comparator 46. The output 52 of ADC circuit 42 forms an input to the input 54 of DAC 44 and to another input port 56 of controller 22. The output 58 of DAC 44 connects to the inverting input 60 of comparator 46 while the comparator output 62 connects to input 32 of controller 22. Port 56 is bidirectional and can accept a digital signal from the ADC output 52. Port 56 can also provide a digital output that represents a lift valve to the DAC input 54.

The system operates in the following way. The intake valve command that is delivered to input 24 of controller 22 contains the desired valve opening and closing as functions of absolute crankshaft rotational position. Valve lift could also be given in addition to or in place of valve opening or closing since two of the three parameters, valve opening, valve closing, and valve timing, are necessary and sufficient to provide adequate information for controller 22 to act on. The instantaneous position of valve 10 is made known to controller 22 via lift sensor 28 and processing circuit 30. Controller 22 calculates an error signal that is delivered to solenoid driver 20 to cause valve 10 to follow the command from controller 26. The signal from the lift sensor is calibrated to zero (re-calibrated) every time that valve 10 closes so that the sensor is precisely calibrated each time before the valve opens. An advantage of the invention is that a relatively inexpensive device, namely a Hall device, can be used for lift sensor 28. Deviations in uncontrolled influences on valve timing accuracy are thereby compensated so that faithful correspondence between command and result are attained despite such deviations.

Thus, the invention can be seen to provide a meaningful improvement in the control of solenoid-controlled intake and/or exhaust valves of internal combustion engines, and while a preferred embodiment has been disclosed, it should be appreciated that principles are applicable to other embodiments.

What is claimed is:

1. In an internal combustion engine having one or more solenoid-controlled valves that are operated to open and close combustion chambers in variable phasing to engine crankshaft rotation, said engine also having an electronic management controller for issuing commands for various engine functions including command of the phasing of said solenoid-controlled valves in relation to engine crankshaft rotational position, the improvement comprising a closed loop control system for the closed loop control of the phasing of said solenoid-controlled valves, said system comprising an electronic valve controller having multiple input means and output means, a lift sensor for each of said valves for sensing valve lift, a lift sensor processing circuit for each lift sensor for coupling the corresponding lift sensor with a corresponding one of said electronic valve controller input means, means providing to another of said electronic valve controller input means real time information about current crankshaft rotational position in relation to a known reference, means supplying from said electronic management controller to a further one of said electronic valve controller input means a command for the phasing of said solenoid-controlled valves, a driver circuit for each of said valves for coupling the corresponding controlling solenoid with a corresponding one of said electronic valve controller output means, said electronic valve controller comprising means for closed loop controlling, by means of the corresponding lift sensor and lift sensor processing circuit, each solenoid-controlled valve to operate under the command delivered from said electronic management controller to said further one of said input means, and each lift sensor processing circuit comprising means for processing information from the corresponding lift sensor to disclose to said electronic valve controller, as the corresponding valve operates, the actual opening and closing of the valve, wherein said means for processing information includes a means to accurately re-calibrate the lift sensor each time before the valve opens.

2. The improvement set forth in claim 1 wherein said lift sensor comprises a Hall device.

3. The improvement set, forth in claim 1 wherein said means to accurately re-calibrate the lift sensor comprises a comparator having two inputs and an output, a DAC having an input and an output, and an ADC having an input and an output, and wherein said lift sensor forms an input to one input of said comparator and the input of said ADC, the output of said ADC is coupled to the input of said DAC, the output of said DAC is coupled to the other input of said comparator, and the output of said comparator is coupled to said electronic valve controller.

4. In an internal combustion engine having one or more solenoid-controlled valves that are operated to open and close combustion chambers in variable phasing to engine crankshaft rotation, such engine also having an electronic management controller for issuing commands for various engine functions including command of the phasing of the solenoid-controlled valves in relation to engine crankshaft rotation, the invention comprising a closed loop control system for the closed loop control of the phasing of the solenoid-controlled valves, said system comprising an electronic valve controller having multiple input means and output means, a lift sensor for each of the valves for sensing valve lift, a lift sensor processing circuit for each lift sensor for coupling the corresponding lift sensor with a corresponding one of said electronic valve controller input means, means providing for another of said electronic valve controller input means to receive real time information about current crankshaft rotational position in relation to a known reference, means for receiving from the electronic management controller at a further one of said electronic valve controller input means a command for the phasing of the solenoid-controlled valves, a driver circuit for each of the valves for coupling the corresponding controlling solenoid with a corresponding one of said output means, said electronic valve controller comprising means for closed loop controlling, by means of the corresponding lift sensor and lift sensor processing circuit, each solenoid-controlled valve to operate under the command received from the electronic management controller at said further one of said input means, and each lift sensor processing circuit comprising means for processing information from the corresponding lift sensor to disclose to said electronic valve controller, as the corresponding valve operates, the actual opening and closing of the valve, wherein said means for processing information includes a means to accurately re-calibrate the lift sensor each time before the valve opens.

5. The invention set forth in claim 4 wherein said lift sensor comprises a Hall device.

6. The invention set forth in claim 4 wherein said means to accurately re-calibrate the lift sensor comprises a comparator having two inputs and an output, a DAC having an input and an output, and an ADC having an input and an output, and wherein said lift sensor forms an input to one input of said comparator and the input of said ADC, the output of said ADC is coupled to the input of said DAC, the output of said DAC is coupled to the other input of said comparator, and the output of said comparator is coupled to said electronic valve controller.

* * * * *